US008246204B2

(12) United States Patent
McCanless

(10) Patent No.: US 8,246,204 B2
(45) Date of Patent: Aug. 21, 2012

(54) COVER ASSEMBLY FOR LIGHT EMITTING DIODES

(75) Inventor: Forrest McCanless, Oxford, GA (US)

(73) Assignee: ABL IP Holding LLC, Conyers, GA (US)

( * ) Notice: Subject to any disclaimer, the term of this patent is extended or adjusted under 35 U.S.C. 154(b) by 186 days.

(21) Appl. No.: 12/724,485

(22) Filed: Mar. 16, 2010

(65) Prior Publication Data

US 2010/0232158 A1 Sep. 16, 2010

Related U.S. Application Data

(60) Provisional application No. 61/160,427, filed on Mar. 16, 2009.

(51) Int. Cl.
*F21V 21/00* (2006.01)

(52) U.S. Cl. ..... 362/249.02; 362/200; 362/646

(58) Field of Classification Search ..... 362/101, 362/155, 190, 191, 196, 200, 249.02, 249.05, 362/295, 394, 646, 652
See application file for complete search history.

(56) References Cited

U.S. PATENT DOCUMENTS

| | | | | |
|---|---|---|---|---|
| 4,829,771 | A | 5/1989 | Koslow et al. | |
| 6,902,304 | B2 * | 6/2005 | Yang | 362/155 |
| 6,945,683 | B2 | 9/2005 | Gross et al. | |
| 7,204,615 | B2 | 4/2007 | Arik et al. | |
| 7,401,936 | B1 | 7/2008 | Fan | |
| 7,845,829 | B2 * | 12/2010 | Shaner | 362/249.02 |
| 7,914,162 | B1 * | 3/2011 | Huang | 362/249.02 |
| 2004/0032734 | A1 * | 2/2004 | Chen | 362/196 |
| 2005/0152138 | A1 * | 7/2005 | Tatebe | 362/200 |
| 2006/0151801 | A1 | 7/2006 | Doan et al. | |
| 2006/0268548 | A1 | 11/2006 | Chang | |
| 2006/0268565 | A1 | 11/2006 | Chang | |
| 2007/0019409 | A1 | 1/2007 | Nawashiro et al. | |
| 2007/0064427 | A1 | 3/2007 | Sibalich et al. | |
| 2008/0043480 | A1 | 2/2008 | Kong | |
| 2008/0158885 | A1 | 7/2008 | Lai et al. | |
| 2008/0285271 | A1 | 11/2008 | Roberge et al. | |
| 2009/0034261 | A1 | 2/2009 | Grove | |
| 2009/0073697 | A1 | 3/2009 | Peck et al. | |

OTHER PUBLICATIONS

Lighting Science Group, BayLume Specification Sheet (dated Feb. 2010).
Lighting Science Group, Flat LowBay Specification Sheet (dated Mar. 2010).
BetaLED, 304 Series Parking Structure Technical Documents & Specifications, available at http://www.betaled.com/us-en/TechnicalLibrary/TechnicalDocuments/304-series-parking.aspx (last accessed Oct. 27, 2010).

(Continued)

*Primary Examiner* — Y My Quach Lee
(74) *Attorney, Agent, or Firm* — Kilpatrick Townsend & Stockton LLP

(57) ABSTRACT

A lighting assembly can comprise a cover and mounting assembly configured to receive and support a board-mounted LED. The cover and mounting assembly can comprise an outer surface with an opening corresponding to each board-mounted LED while otherwise covering the board of the LED. The cover and mounting include mounting points on its underside along with contact points positioned so that when the board-mounted LED is secured with the cover and mounting assembly, wires on the underside are brought into electrical connection with contacts of the board of the LED.

17 Claims, 2 Drawing Sheets

OTHER PUBLICATIONS

BetaLED, The EDGE Parking Structure Technical Documents & Specifications, available at http://www.betaled.com/us-en/TechnicalLibrary/TechnicalDocuments/TheEdgeParking.aspx (last accessed Oct. 27, 2010).

http://lsgc.com/products/exterior-luminaires/baylume-exterior/.

http://lgsc.com/products/exterior-luminaires/low-bay-exterior/.

http://www.betaled.com/prd-parking.aspx.

* cited by examiner

COVER ASSEMBLY FOR LIGHT EMITTING DIODES

PRIORITY CLAIM

This application claims priority to U.S. Provisional Patent Application No. 61/160,427, filed Mar. 16, 2009, which is incorporated by reference herein in its entirety.

BACKGROUND

Lighting devices may use one or more light sources mounted in an assembly that supports the light source(s) and associated electrical components. For example, incandescent or fluorescent light sources may be mounted in a fixture that includes a socket for the light source(s) and allows the light source(s) to be secured to a part of a building (e.g., a wall or ceiling) or to another suitable structure (e.g., a lamp post, vehicle). A fixture may also include openings or other elements to route power supply and/or control components to the light source(s).

Light emitting diodes (LEDs) are increasingly viewed as an option for use alongside or instead of incandescent, fluorescent, and/or other light sources. LEDs may be packaged "individually" such that an LED is provided with lead wires for powering or controlling the LED; in practice the "individual" LEDs may actually be packaged in groups or strips. However, some LEDs may be board-mounted—that is, the LED is mounted to a circuit board or other unit that includes contacts for powering the LED. Various challenges are encountered in integrating LEDs into light fixtures and otherwise providing for the safe use of LEDs in lighting applications.

SUMMARY

In accordance with one or more aspects of the present subject matter, a lighting assembly can be used to support one or more LEDs while ensuring resilient and safe electrical connections.

For example, a lighting apparatus can comprise a cover assembly, the cover assembly comprising a body defining an interior surface, an exterior surface, and at least one opening, with an electrical connector positioned on the interior surface of the body. The electrical connector can be positioned so that when a board-mounted lighting device is positioned with the lighting device in the opening and the board secured to the interior surface, a contact of the board mounted lighting device is electrically connected to the electrical connector.

For example, an LED assembly can comprise a cover/mounting assembly configured to receive and support a board-mounted LED. The cover and mounting assembly can comprise an outer surface with an opening corresponding to each board-mounted LED while otherwise covering the board of the LED. The cover and mounting assembly can include mounting points on its underside along with contact points positioned so that when the board-mounted LED is secured to the cover and mounting assembly, wires on the underside are brought into electrical connection with contacts of the board of the LED, such as contacts on the top of the board.

In some embodiments, the body includes a plurality of bosses protruding from the interior surface and configured to receive contact leads and couple the leads to lead wires. When the board-mounted lighting device is positioned on the cover, the contact leads can be brought into contact with contacts on the board. The lead wires can be connected to a power source, such as an alternating-current power source. In some embodiments, the cover comprises a nonconductive material, such as polycarbonate plastic.

These illustrative embodiments are discussed not to limit the present subject matter, but to provide a brief introduction. Additional examples of embodiments of systems and methods configured in accordance with the present subject matter are described below in the Detailed Description. Objects and advantages of the present subject matter can be determined upon review of the specification and/or practice of an embodiment configured in accordance with one or more aspects taught herein.

BRIEF DESCRIPTION OF THE DRAWINGS

A full and enabling disclosure is set forth more particularly in the remainder of the specification. The specification makes reference to the following appended figures, in which use of like reference numerals in different features is intended to illustrate like or analogous components.

DETAILED DESCRIPTION

Reference will now be made in detail to various and alternative exemplary embodiments and to the accompanying drawings, with like numerals representing substantially identical structural elements. Each example is provided by way of explanation, and not as a limitation. It will be apparent to those skilled in the art that modifications and variations can be made. For instance, features illustrated or described as part of one embodiment may be used on another embodiment to yield a still further embodiment.

Figure 1:
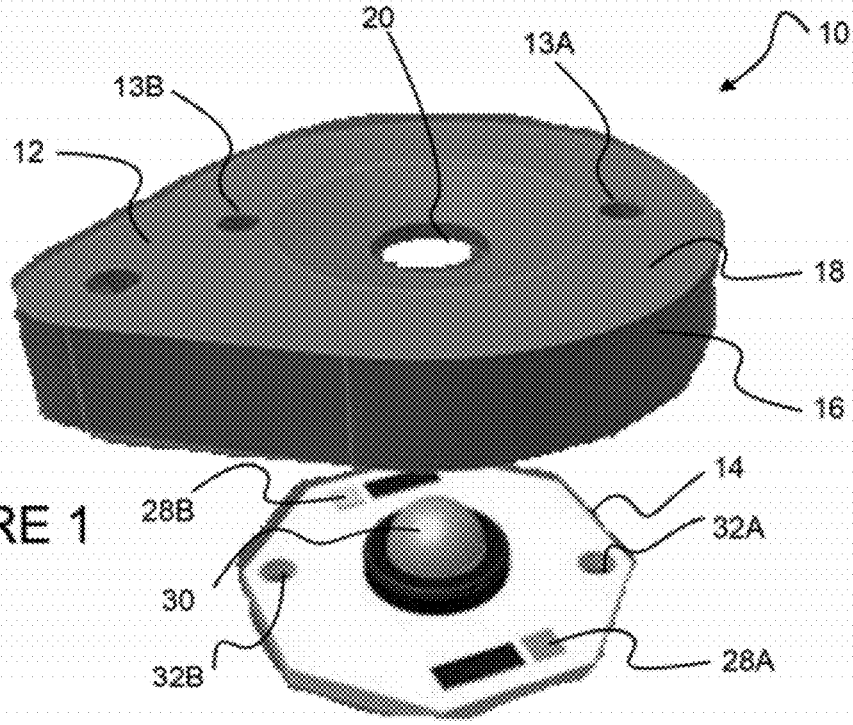
FIG. 1 is a view of components of a lighting assembly comprising a cover and mounting assembly along with a board-mounted LED.

FIG. 1 depicts a lighting assembly 10 comprising a cover and mounting assembly 12 along with a board 14 featuring a board-mounted LED 30. In this view, the outer surface of cover and mounting assembly 12 is visible, namely perimeter 16 and top side 18. Top side 18 of cover and mounting assembly 12 features an opening 20 that corresponds to LED 30 of board 14. Top side 18 also features openings 13A and 13B that will be discussed later below.

In this example, cover and mounting assembly 12 has a "teardrop" shape, although other suitable shapes such as circles, ellipses, or any other shape could be used. Generally, assembly 12 can define an interior surface and exterior surface—in this example, the interior surface is defined by the underside 19 of the cover and the interior of the perimeter. Assembly 12 may be formed from any suitable material or materials, including, but not limited to, plastic such as polycarbonate. In some embodiments, assembly 12 is formed as a single unit by injection molding, although other fabrication techniques may be utilized and assembly 12 could be fabricated by joining multiple parts.

Figure 2:
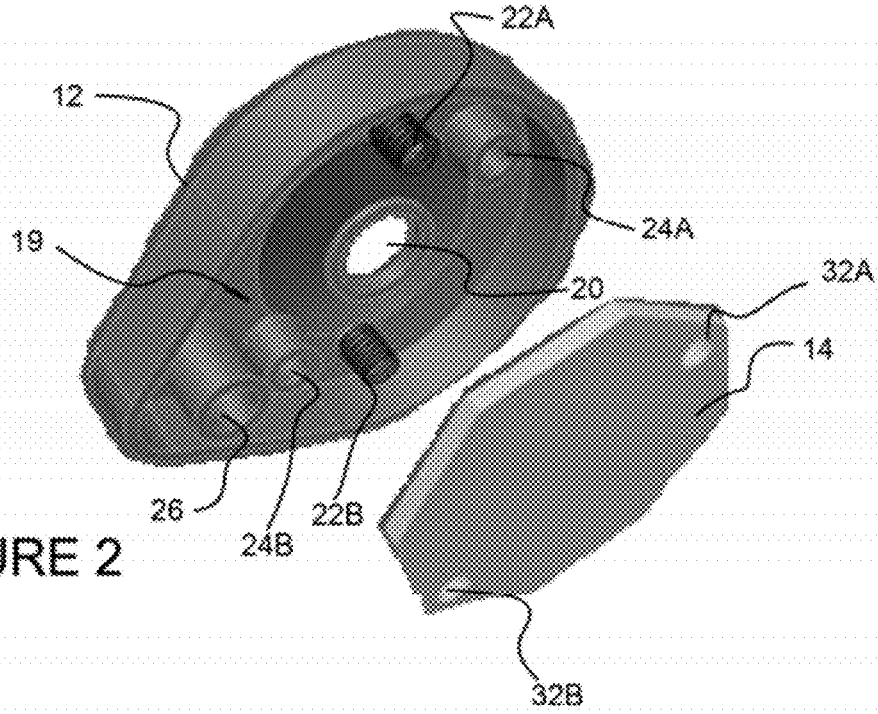
FIG. 2 depicts the underside of the cover and mounting assembly and the board-mounted LED of FIG. 1.

FIG. 2 depicts cover and mounting assembly 12 and the board-mounted LED of FIG. 1 as viewed from the bottom. Thus, the underside 19 of cover and mounting assembly 12 (and the bottom of board 14) are visible. As can be seen in FIG. 2, perimeter 16 extends from underside 19 to form a partially-enclosed space for receiving board 14. As noted below, the cover and mounting assembly can include one or more features for use in supporting electrical connectors and one or more other features for use in securing a board-mounted lighting device to the body of the cover.

In this example, cover and mounting assembly 12 includes contact leads 22A and 22B, mounts 24A and 24B for use in securing the board to the cover, and lead wire guidance boss 26 extending outward from underside 19 in the enclosed space formed by cover and mounting assembly 12. As will be discussed below, in some embodiments tapered bosses can be used to support contact leads 22A and 22B, though other structures could be used.

Mounts 24A and 24B comprise structures positioned to correspond to mounting holes 32A and 32B of board 14 and allow board 14 to be secured to cover and mounting assembly 12 in any suitable manner. For example, mounts 24 may comprise holes for receiving screws or other suitable fasteners for attaching board 14.

Contact leads 22A and 22B are positioned so that, when board 14 is secured to cover and mounting assembly 12, contact leads 22A and 22B are brought into electrical contact with contact points 28A and 28B of board 14 (visible in FIG. 1). In this example, contact leads 22A and 22B comprise spring contacts, but other suitable contact mechanisms could be used.

FIG. 2 also illustrates lead wire routing boss 26, which in this example is a hollow cylindrical member with an opening in its side (not visible) and end for receiving lead wires. Boss 26 can be positioned to allow for lead wires to be routed through boss 26 and into the interior of the enclosed space formed by underside 19 and perimeter 16 as shown in FIGS. 3-4 below.

Figure 3:
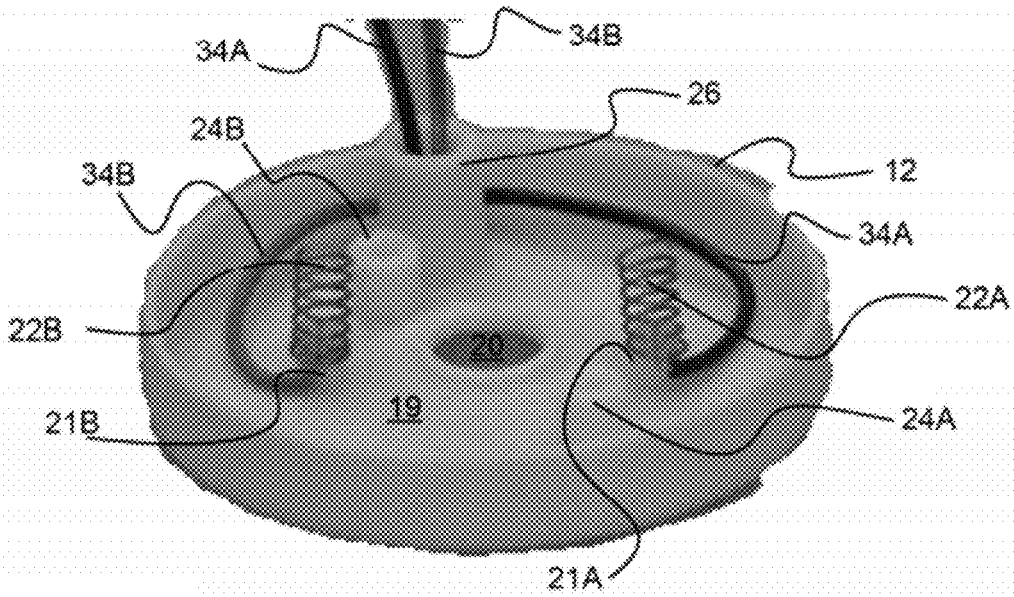
FIG. 3 illustrates the underside of the cover and mounting assembly in closer detail.

FIG. 3 illustrates the underside 19 of cover and mounting assembly 12 in closer detail. This view also shows lead wires 34A and 34B connected to contact leads 22A and 22B, respectively. In some embodiments, contact leads 22A and 22B can be mounted to tapered bosses 21A and 21B extending outward from underside 19 and including a v-notch for receiving and supporting an end of wires 34A and 34B. In some embodiments, contact leads 22A and 22B can be rotated so that the free end of each respective lead 22 curls under and retains its respective wire 34 in conjunction with its respective tapered boss 21. FIG. 3 also shows routing boss 26, receiving lead wires 34A and 34B and routing the lead wires 34 away from the underside of cover and mounting assembly 12.

Figure 4:
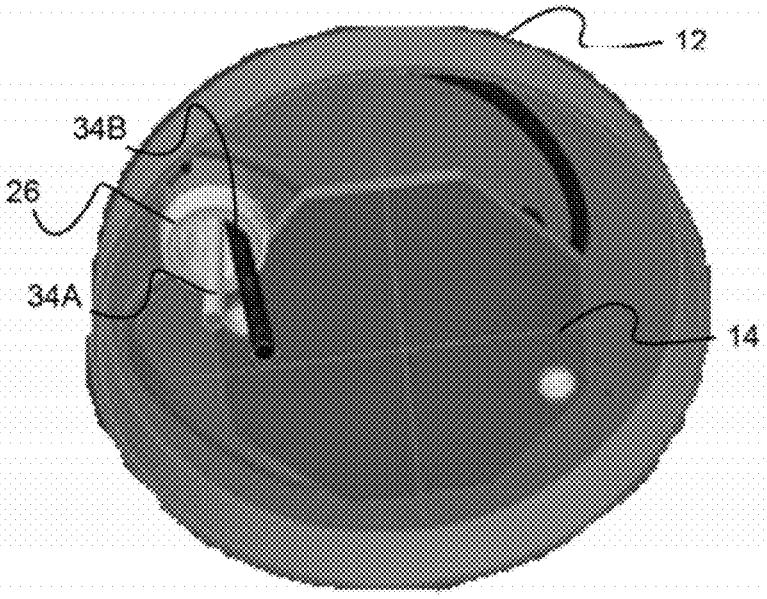
FIG. 4 illustrates a board-mounted LED secured to a cover and mounting assembly as viewed from the underside.

FIG. 4 illustrates a board-mounted LED secured to cover and mounting assembly 12 as viewed from the underside and showing lead wires 34A and 34B being directed away from the underside of assembly 12. For example, lead wires 34 can be connected to a suitable power source for powering LED 30 via contact leads 22A and 22B and contact points 28A and 28B.

LEDs may use alternating current (AC) or direct current (DC) power sources. Certain embodiments of a cover and mounting assembly 12 may find application in safely mounting AC LEDs so that use of such LEDs complies with Underwriters Laboratories (UL) or other applicable standards. For example, some standards may require LED power leads and other parts to be physically covered to meet 5 VA flame requirements. Use of a cover and mounting assembly 12 comprising an appropriate nonconductive material may allow for board 14 and lead wires 34 to be adequately covered to meet such a standard without requiring modification of board 14. Additionally, the cover and mounting assembly can otherwise protect the board, LEDs, and connecting components from tampering or accidental damage.

Use of a cover and mounting assembly may additionally allow for simplified assembly of lighting devices using board-mounted LEDs. For example, no specialized tools are needed to attach the lead wires in some embodiments. A method of providing a lighting assembly can comprise routing lead wires 34 through boss 26 of the cover and mounting assembly and twisting on contact leads 22 at the bosses. Then, board 14 can be positioned so that contacts 28 of board 14 are aligned with leads 22 and mounting holes 32 of the board are aligned with mounts 24. Board 14 can be attached via mounting holes 32 and then the lead wires 34 can be connected to a suitable power supply.

In some embodiments, the lighting assembly can be included in another fixture, such as a "night light" or emergency light mounted to the interior of a fluorescent or other light fixture. Briefly returning to FIG. 1, for example, openings 13A and 13B (corresponding to points for forming mounts 24 on underside 19) may be used to receive members of the other light fixture such as burrs that allow cover and mounting assembly 12 to be "snap-mounted" to the fixture such that the burrs (or other member) extend through mounting holes 32, mounts 24, and out to top side 18 to secure the entire assembly to the other light fixture. Of course, the board-mounted LED(s) could be the exclusive source of light in a fixture as well.

The examples above featured a single LED 30. A cover and mounting assembly 12 could include multiple openings 20 corresponding to respective LEDs 30 of a board 14 featuring multiple LEDs or could include sufficient mounting points 24 for simultaneously mounting multiple boards 14 in the same cover and mounting assembly. The examples above also featured two contact leads 22, two board contacts 28, and two lead wires 34. However, other embodiments could support more board contacts (whether on a single board or multiple boards) by including an appropriate contact lead 22 for each board contact and lead wire 34.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

What is claimed:

1. A lighting apparatus, comprising:

a cover assembly, the cover assembly comprising a body defining an interior surface, an exterior surface, and at least one opening; and an electrical connector positioned on the interior surface of the body, wherein the electrical connector comprises a plurality of contact leads and is positioned so that when a board-mounted lighting device is positioned with the lighting device in the opening and with the board secured to the interior surface, a contact of the board mounted lighting device is electrically connected to the electrical connector, and wherein the body comprises a plurality of bosses protruding from the interior surface, each boss configured to receive one of the contact leads and one of a plurality of lead wires routed along the interior surface of the body.

2. The apparatus set forth in claim 1, further comprising:

a board-mounted lighting device, wherein the board-mounted lighting device comprises at least one light emitting diode and at least one contact, the light emitting diode positioned in the opening and the at least one contact electrically connected to the electrical connector.

3. The apparatus set forth in claim 1, further comprising a board-mounted lighting device comprising a light emitting diode, the board-mounted lighting device configured to be coupled to an alternating current power source using the plurality of lead wires.

4. The apparatus set forth in claim 1, wherein the body comprises a top defining a top side and a bottom side and a perimeter extending from the bottom side, the interior surface bordering the space enclosed by the perimeter and the bottom side, wherein the opening is in the top, and wherein the electrical connector is positioned on the bottom side.

5. The apparatus set forth in claim 1, mounted to a light fixture.

6. The apparatus set forth in claim 1, wherein the body comprises polycarbonate plastic.

7. A lighting apparatus, comprising:

a cover assembly, the cover assembly comprising a body having a top defining a top side opposite a bottom side and a perimeter extending from the bottom side, the perimeter and the bottom side defining an interior surface and the top comprising at least one opening, wherein the body comprises at least a first feature on the bottom side configured to support an electrical connector and at least a second feature on the bottom side configured for use in securing a board-mounted lighting device to the body, the first and second features configured so that, when the board mounted device is positioned in the opening and secured to the body, a contact of the board mounted lighting device is electrically connected to the electrical connector.

8. The lighting apparatus set forth in claim 7, wherein the first feature comprises at least one boss and the electrical connector comprises a at least one contact lead attached to the at least one boss.

9. The lighting apparatus set forth in claim 8, further comprising:

a board-mounted lighting device comprising a plurality of mounting points and positioned with the lighting device in the opening, wherein the second feature comprises a plurality of mounts positioned to correspond to the mounting points of the board-mounted lighting device.

10. The lighting apparatus set forth in claim 9, wherein the mounting points of the board-mounted lighting device comprise holes, and wherein the board-mounted lighting device is secured to the cover assembly by a fastener passing through the holes and into the mounts of the cover assembly.

11. The lighting apparatus set forth in claim 10, wherein first feature comprises a plurality of tapered bosses, each tapered boss configured to connect a contact lead to a lead wire.

12. The lighting apparatus set forth in claim 11, wherein the lead wires are routed along the bottom side of the cover and then away from the bottom side by a wire routing boss.

13. The lighting apparatus set forth in claim 11, wherein the lead wires are connected to an alternating current power source.

14. A method, comprising aligning a board-mounted lighting device with a cover defining an opening so that a light-emitting diode of the board-mounted lighting device is positioned to emit light through the opening;

placing at least one electrical contact disposed on a top surface of a board of the board-mounted lighting device in electrical contact with a corresponding contact lead disposed on a bottom surface of the cover; and prior to aligning and placing, routing at least one lead wire through a corresponding boss extending from the bottom surface of the cover and connecting the at least one lead wire to the at least one electrical contact.

15. The method set forth in claim 14, wherein aligning comprises aligning a plurality of holes in the board of the board-mounted lighting device with corresponding mounts disposed on the bottom surface of the cover, and wherein the method further comprises securing the board to the cover using a fastening member passing through the holes.

16. The method set forth in claim 14, wherein connecting the at least one lead wire to the at least one electrical contact comprises positioning the at least one lead wire at the corresponding boss extending from the bottom surface and twisting a corresponding contact lead onto the corresponding boss so as to place the corresponding contact lead in electrical connection with the at least one lead wire.

17. The method set forth in claim 14, further comprising a plurality of lead wires and connecting the plurality of lead wires to an alternating current power source.

* * * * *